United States Patent [19]

Wade et al.

[11] Patent Number: 4,469,539

[45] Date of Patent: Sep. 4, 1984

[54] PROCESS FOR CONTINUOUS PRODUCTION OF A MULTILAYER ELECTRIC CABLE

[75] Inventors: Robert M. Wade, Wabash, Ind.; George N. Benjammin, Stamford, Conn.; Marwick H. Solomon, Marion; Daniel H. Jessop, Middletown, both of Ind.

[73] Assignee: Anaconda-Ericsson, Inc., Malvern, Pa.

[21] Appl. No.: 506,584

[22] Filed: Jun. 22, 1983

Related U.S. Application Data

[63] Continuation of Ser. No. 288,503, Jul. 30, 1981, abandoned, which is a continuation-in-part of Ser. No. 233,303, Feb. 10, 1981, abandoned.

[51] Int. Cl.[3] ..... H01B 13/14

[52] U.S. Cl. ..... 156/51; 156/298; 174/105 SC; 174/115; 174/120 SC; 427/120; 428/383

[58] Field of Search ..... 29/825, 828; 156/47, 156/51, 298; 174/102 SC, 105 SC, 106 SC, 110 PM, 115, 120 SC; 264/176 R; 427/118, 120; 428/380, 383

[56] References Cited

U.S. PATENT DOCUMENTS 3,474,189 10/1969 Plate et al. ..... 174/115
3,816,347 6/1974 Luh ..... 252/511
3,876,462 4/1975 Carini et al. ..... 174/110 PM X
3,904,588 9/1965 Greene ..... 525/329.6

*Primary Examiner*—Robert A. Dawson
*Attorney, Agent, or Firm*—Allegretti, Newitt, Witcoff & McAndrews, Ltd.

[57] ABSTRACT

An improved multilayer electric cable is disclosed having a conductive core, an extruded strand shield (ESS) layer, an insulating layer of polymeric insulation material surrounding the core and coaxial therewith, a semiconductive insulation shield (EIS) layer strippably bonded to the insulation layer surrounding it and coaxial therewith and, preferably, a plurality of axially extending drain wires disposed within the semiconductive EIS layer. The semiconductive EIS layer is formed of a copolymer of an ethylene/acrylate/monoalkyl ester of 1,4-butenedioic acid copolymer, conductive carbon black, a peroxide curing agent and polyethylene or polyethylene copolymer. The semiconductive EIS layer is applied by extrusion at elevated temperature in a dry gas atmosphere. Such dry processing conditions are sufficiently severe that the copolymer of ethylene/acrylate/ester can reliably serve as a suitable basis for the semiconductive EIS layer, since other conventional semiconductive compositions are susceptible to being adversely affected by the severe conditions of dry processing.

13 Claims, 5 Drawing Figures

PROCESS FOR CONTINUOUS PRODUCTION OF A MULTILAYER ELECTRIC CABLE

This is a continuation of application Ser. No. 288,503 filed July 30, 1981 which was a continuation-in-part of application Ser. No. 233,303 filed Feb. 10, 1981, both now abandoned.

BACKGROUND OF THE INVENTION

This invention relates to multilayer electric cables and materials therefor.

Multilayer electric cable constructions are well known in the art and are utilized for the transmission of medium and high voltage electric current. The basic single conductor medium voltage cable commonly utilized by the industry today comprises a conductor surrounded by an extruded strand shield (ESS). Superimposed over the extruded strand shield is an insulation layer that, in turn, has strippably bonded thereto an extruded insulation shield (EIS). A metallic shield comprising flat copper tapes or round wires are helically positioned over the extruded insulation shield to complete the shielding system for the cable. An outer jacket can then be placed, if necessary, over the wire or tape to provide the final, finished cable construction. A particularly preferred multilayer cable utilizes corrugated wires embedded in the extruded insulation shield and is illustrated in U.S. Pat. No. 3,474,189, the teachings of which are incorporated by reference herein. This type of cable is manufactured and sold by the Anaconda-Ericsson Inc. under the trademark "UniShield".

It would be desirable to manufacture multilayer electric cable in a continuous process to minimize handling of the cable during the intermediate stages of its production and to minimize production time and in-process storage. It would also be desirable to utilize dry conditions (a high temperature dry gas atmosphere) to cure the various polymeric materials in the cable. Dry curing avoids the moisture infiltration problems and drying steps necessary in the prior art processes.

It has been discovered, however, that the conventional extruded insulation shield compositions are not adequately suited for high temperature dry curing. Thermoplastic compositions applied and then cured simultaneously with the insulation layer will completely bond together and cannot be stripped apart during subsequent splicing operations. Existing strippable, thermosetting compositions are either not sufficiently flame retardant, deformation resistant or thermally stable to withstand the high temperature present in a dry cure process, e.g. 200° C. or higher.

Representative prior art pressurized, high temperature curing processes for continually vulcanizing and manufacturing electric cables are illustrated in U.S. Pat. Nos. 3,645,656; 3,846,528 and 3,901,633, the teachings of which are incorporated by reference herein.

SUMMARY OF THE INVENTION

In its broadest embodiment the invention herein has an electrical conductor which comprises a conductive core; an extruded strand shield layer surrounding the core and coaxial therewith; an insulating layer of polymeric insulation material surrounding the extruded strand shield layer and coaxial therewith; a semiconductive insulation shield layer surrounding and strippably bonded to the insulating layer and coaxial therewith, with the semiconductive insulation shield layer comprising (1) a copolymer of ethylene, an alkyl acrylate and a monoalkyl ester of 1,4-butenedioic acid, (2) conductive carbon black (3) a curing agent, preferably a peroxide curing agent, and (4) polyethylene or a polyethylene copolymer, and preferably a plurality of axially extending drain wires disposed within the semiconducting insulation shield layer, with the conductor being formed by seriatim coaxial extrusion of the layers around the core and subsequent dry curing of the polymeric components of the layers.

Other embodiments of the present invention will be developed in or are evident from the following more detailed description of the cable structure.

DETAILED DESCRIPTION AND PREFERRED EMBODIMENTS

Figure 1:
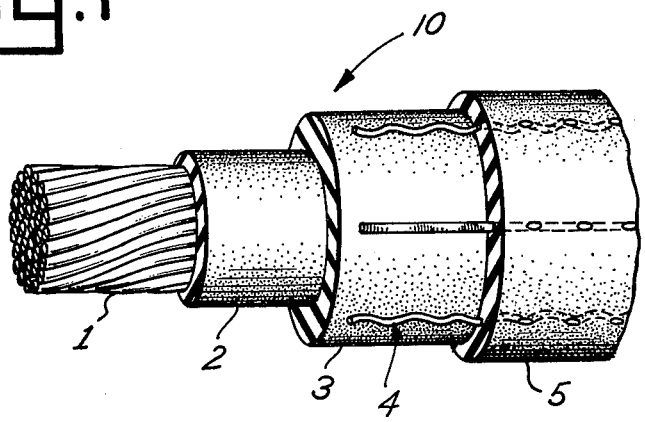
FIG. 1 is a schematic, partial, sectional view of a preferred conductor (cable) product manufactured in accordance with the present invention.

Referring to FIG. 1, there is illustrated a medium voltage cable 10 manufactured in accordance with the teachings of the present invention. Cable 10 comprises a copper conductive core which comprises stranded conductor 1 surrounded by a conventional polymeric semiconducting extruded strand shield (ESS) 2, formed for example of a polymer of ethylene or ethylene and propylene and containing conductive carbon black, as shown in U.S. Pat. No. 3,479,446 to Arnaudin and Wade. To illustrate with a representative example, the conductor may be a #4/0 19/W copper conductor with a nominal diameter of 0.4 inches (1.0 cm.). The typical nominal thickness of extruded strand shield 2 positioned around that conductor is approximately 0.1 inches (0.25 cm). An insulation layer 3 of conventional polymeric cross-linked polyethylene (XLP), (EPM) and/or ethylene propylene diene monomer (EPDM) elastomeric material is positioned around extruded strand shield 2. Typically (with reference to the exemplary embodiment described above) the insulation layer 3 is applied in an amount sufficient to provide an outer nominal diameter of about 0.69 inches (1.8 cm). Corrugated soft copper drain wires 4 (typically six in number and #19 gauge) are positioned parallel to conductor 1 and are embedded in a semiconducting insulation shield (EIS) 5 (providing, typically, a nominal final diameter for cable 10 of approximately 0.88 inches (2.24 cm)). EIS 5 is strippably applied or bonded to insulation layer 3.

EIS 5 is a semiconductive layer which comprises at least four components. The first component is a copolymer of ethylene, an alkylacrylate and a monoalkyl ester of 1,4-butenedioic acid. Copolymers of this type are described in U.S. Pat. No. 3,904,588 and are commercially available from E. I. duPont de Nemours & Company. They have been also described for use as electrical cable jacketing (see Hagman, et al. "Ethylene/Acrylic Elastomers," *Rubber Age* (May, 1976)) but in this disclosure only steam curing was contemplated and semiconducting jackets were not disclosed. The presence of this component in the semiconductive layer is critical, for it has been found that, unlike prior art compositions, the compositions of this invention containing this type of copolymer are sufficiently heat resistant to be used in manufacturing an electrical cable of this type by a dry curing process. Other polymeric materials such as the neoprene, polyethylene or ethylene propylene (EPM) copolymers described in U.S. Pat. No. 3,474,189 to Plate and Arnaudin, the cross-linked polyethylene described in U.S. Pat. No. 3,792,192 to Plate or the chlorinated polyethylene and ethylene ethylacrylate described in U.S. Pat. No. 3,735,025 to Ling, Wade and Solomon may be adversely affected by the severe temperature conditions of the dry cure process. The undesirable effect resulting with the prior art polymers is the degradation of the semiconductive layer polymer.

In this first component the alkylacrylate monomer can be either methyl acrylate or ethyl acrylate, with the former being preferred.

The monoalkyl ester of 1,4-butenedioic acid is formed with an alkyl group of from 1 to 6 carbon atoms. Both cis and trans-1,4-butenedioic acid (i.e. maleic and fumaric acids) may be used. The preferred alkyl groups are methyl, ethyl and propyl and the preferred acid is maleic acid, with the most preferred ester being the ethyl ester.

The basis against which the amounts of the other components are determined is 100 parts by weight of total polymer. If no ethylene, ethylene copolymer, EPM or EPDM copolymer is present (see below) the first component will be the whole 100 parts. Normally, however, it will be 50 to 83 parts and the remainder of 17 to 50 parts will be an ethylene, ethylene copolymer, EPM or EPDM copolymer.

The second component of the semiconductive EIS layer is an electrically conductive carbon black such as a conductive furnace black or acetylene black. Semiconductive carbon blacks as components of electrical conductors are described in U.S. Pat. No. 3,735,025 and also in U.S. Pat. No. 3,816,347. A variety of suitable conductive carbon blacks are commercially available from several suppliers.

The third component of the composition is a curing agent which will promote the curing and cross-linking of the aforementioned copolymer. Suitable peroxide and diamine curing agents are described in the aforementioned *Rubber Age* article and U.S. Pat. No. 3,904,588; mixtures of these materials may be used.

In general the electrically conductive carbon black will be present as 10 to 150 parts by weight per 100 parts by weight of total polymer while the curing agent will be present as 1 to 20 parts by weight per 100 parts by weight of total polymer.

Depending on the particular polymer used to form the insulating layer to which the semiconductive EIS layer is to be strippably bonded, different degrees of adhesion will be obtained. The strippable bond which is necessary in the conductors of this invention will be a bond which is sufficiently adherent between the semiconductive EIS layer and the insulating layer so that no delamination occurs during normal service and handling of the cable but is not so strong that a workman cannot readily strip the semiconductive EIS layer away for routine splicing operations. Those skilled in the art will be aware of the particular degree of adhesion to be obtained. The nature of the copolymer used in the semiconductive layer is, however, such that it does not bond readily to some types of insulations, notably the ethylene/propylene/diene (EPDM) polymers. It has therefore been found advantageous in these situations to incorporate into the semiconductive layer composition a fourth component which is polyethylene, a polyethylene copolymer, ethylene and propylene (EPM) or an EPDM copolymer or mixtures hereof to provide the necessary degree of adhesion between the insulating layer and the semiconductive layer. In addition, the polyethylene or polyethylene copolymer serves to harden the total polymeric composition. It has also been found that even where a satisfactory bond is obtained between the semiconducting layer and the insulating layer, that bond can be significantly improved by the incorporation into the semiconducting layer of the polyethylene, a polyethylene copolymer, EPM or EPDM copolymer and it is therefore preferred that the semiconducting layer composition contain this component. Normally the polyethylene, a polyethylene copolymer, EPDM or EPM copolymer component will be present in the composition in amounts of up to 50 parts by weight per 50 parts by weight of the ethylene/acrylate/ester copolymer and preferably 17 to 50 parts by weight per 100 parts by weight of the total polymer content.

Typically, semiconducting EIS layer 5 will have a composition in the following range.

TABLE 1

| Component | Parts by Weight |
|---|---|
| Ethylene/acrylate/ester copolymer | 50–83(a) |
| Polyethylene, polyethylene copolymer, EPDM or EPM copolymer | 17–50 |
| Semiconducting component | 10–150 |
| Crosslinking (curing) agent | 1–20 |
| Other additives | 29–98 |
| Antioxidant | 1–4 |
| Lubricant | 3–9 |
| Flame retarder | 25–85 |

Note:
(a) Commercial copolymers of this type are commonly provided in the form of "masterbatches", which contain some minor proportion (e.g., 15%–20%) of processing aids and similar materials and/or fillers such as carbon black.

The "other additives" are those materials conventionally present in cable jacketing compositions to provide properties such as oxidation resistance, lubrication and/or flame retardancy. Each property may be provided by a single material or by combinations of two or more materials. Quantities used will also be conventional.

Where a material present in the composition provides two functions, each function should be accounted for separately in determining total material present. For instance, carbon black may be present both in the "masterbatch" ethylene/acrylate/ester copolymer and also separately as a "semiconducting component." In this case the total amount of the semiconducting component stated should also include the carbon black provided in the ethylene/acrylate/ester copolymer component if the carbon black in the masterbatch is a conductive carbon black. In the event that it is not a conductive carbon black it should not be counted as part of the semiconducting component but rather should be considered to be just an inert filler. (It will be noted that the quantity of any conductive carbon black normally present in the commercial "masterbatch" ethylene/acrylate/ester copolymer is not sufficient alone to impart significant semiconducting character to the composition.)

Particularly preferred compositions of this invention are as follows:

TABLE 2

| Component | Parts by Weight |
|---|---|
| Ethylene/Acrylate/Ester copolymer (a) | 75 |
| Polyethylene or polyethylene copolymer (b) | 25 |
| Semiconductor component (c) (carbon black) | 25 or 57 |
| Crosslinking (curing) agent (d) | 10 |
| Other additives: | 56 |
| Antioxident (e) | 2 |
| Lubricant (f) | 4.5 |
| Flame Retarder (g) | 49.5 |

Notes:
(a) 90 parts of "Vamac 5634" copolymer; 83% copolymer, 17% XC-72 carbon black and other processing aids; (duPont Elastomers)
(b) Suitable ethylene copolymers include ethylene vinyl acetate and ethylene ethyl acrylate
(c) Mixture of 10 or 42 parts of "Vulcan XC-72" carbon black (Cabot Corp.) with 0–15 parts of "Ketjenblack EC" carbon black (Armak Proc. Chem. Div.); the "Vulcan XC-72" carbon black provided by the "Vamac 5634" copolymer masterbatch is also counted here.
(d) A mixture of 4 parts of N,N'—m-phenylene dimaleimide (HVA #2, duPont Co.) and 6 parts of dicumyl peroxide ("DiCup R", Hercules Chem. Co.)
(e) 4,4'-butylidene-bis-(6-tert-butyl-m-cresol); "Santowhite Powder", (Monsanto Co.)
(f) A mixture of 2.5 parts of octadecylamine (Armeen 18-D Powder; Armak Ind. Chem. Div.) and 2.0 parts of stearic acid (Harwick Chem. Co.)
(g) A mixture of 33.0 parts of ethylene bismide tetrabromophthalic anhydride ("BT-93"; Saytech, Inc.) or decabromodiphenyl oxide ("DE-83", Great Lakes Chem. Co. or "FR-300 BA", Dow Chem. Co.) and 16.5 parts of antimony trioxide (Harshaw Chem. Co.)

These compositions have sufficient semiconducting and flame retardant properties to meet industry standards, are stable at the high temperatures (500°–650° F.; 260°–360° C.) encountered in a high temperature, pressurized dry curing operation and provide a controlled peel strength in the range of about 4 to 24 pounds (1.8–10.9 kg) for ½ inch (1.3 cm) wide strips when jacket 5 is peeled from or otherwise removed for insulation layer 3. In addition, when semiconducting EIS layer 5 is removed from insulation layer 3, there will be no visible amounts of semiconducting EIS layer 5 remaining on insulation layer 3. The composition is prepared by mixing the various components together until a homogenous polymer product is obtained.

Figure 2:
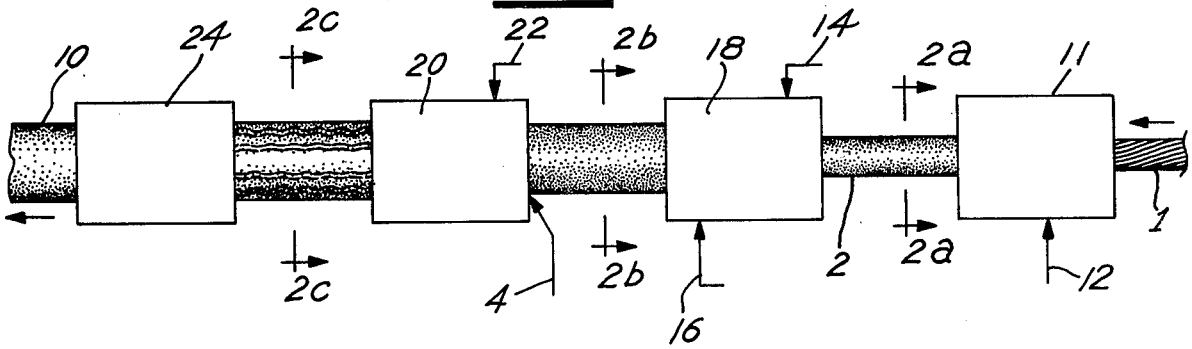
FIG. 2 is a simplified block diagram illustrating the operative steps utilized in the manufacture of the preferred cable product of the present invention.
Figure 2A:
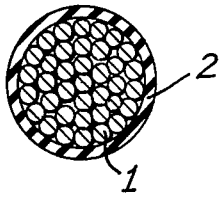
FIGS. 2A, 2B and 2C illustrate the cable structure at various stages of its production as it passes through the process illustrated in FIG. 2.

Referring now to FIG. 2, there is illustrated in a simplified block diagram form, the key operative steps of a process successfully used in the laboratory to manufacture the finished cable 10. The copper conductor 1 is passed to a conventional first extrusion zone 11 wherein an appropriate strand shield polymeric material is introduced by a line 12 and applied by conventional extrusion techniques to conductor 1 to provide an extruded strand shield 2 on conductor 1. The cable configuration as it emerges from the first extrusion zone 11 is illustrated in FIG. 2A.

Figure 2B:
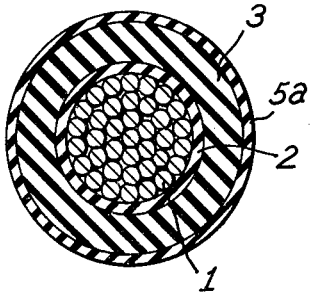

The conductor 1, now coated with the extruded strand shield, is passed to second extrusion zone 18 wherein an appropriately prepared conventional insulation material as described above and provided through line 14 is first applied as layer 3 over the extruded strand shield 2. Within the same second extrusion zone 18 (or in a following extrusion zone for tandem extrusion), extruded insulation shield material entering via line 16 is applied over the insulation layer 3 and the resultant cable is removed from second extrusion zone 18 and passed to third stage extrusion zone 20. The cable structure as it emerges from second extrusion zone 18 is illustrated in FIG. 2B. If no drain wires are to be embedded in the cable, the assemblage may pass on directly to curing zone 24. Pressure to prevent push back must be maintained in pressure tube 30 as described below.

Figure 2C:
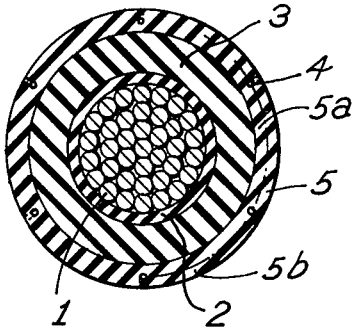

Preferably, however, the drain wires are to be included in the cable. Therefore, in second extrusion zone 18 only one-half of EIS layer 5 is applied (designated "half-layer **5*a*"). Thereafter, the cable, now comprising conductor 1, extruded strand shield 2, insulation layer 3 and half-layer 5*a* of the extruded insulation shield 5 is passed to third extrusion zone 20. Prior to the third extrusion zone 20, drain wires 4 are applied and then in third extrusion zone 20 a second half-layer 5*b* of extruded insulation shield material entering line 22 is applied to the first half-layer 5*a* of extruded insulation shield material to provide a finished but uncured cable structure emerging from third extrusion zone 20. Conductor 1, now containing the uncured strand shield 2, the insulation 3 and the extruded insulation shield layer 5 (with embedded drain wires 4), is then passed directly to curing zone 24 which is in direct communication with extrusion zone 20 wherein the cable is subjected to a high temperature pressurized cure, e.g. about 500°–600° F. (260°–340° C.) and 75–200 psig (5.1–13.6 atm g.) in the presence of a dry inert gas atmosphere for a time sufficient to cure the various polymeric layers present on the conductor and to produce a final finished cable structure 10. The cable structure 10 as it emerges from the third extrusion zone 20 and curing zone 24 is illustrated in FIG. 2C**.

A pressure tube 30 is positioned between second stage extrusion zone 18 and third stage extrusion zone 20 to prevent push back of the first layers due to the pressures imposed from zone 24.

The invention herein may be exemplified by the manufacture, in a single pass, of a 4/0 25 KV power cable having four layers of polymeric materials and corrugated drain wires on a centrally positioned metallic conductor. The layers of polymeric material were applied to the conductor in a sequential manner and were then simultaneously vulcanized in a single operation utilizing a dry curing process with nitrogen or other inert gas as the pressurized curing medium.

The polymeric ESS layer comprised semiconducting polyethylene (PE) or ethylene propylene (EPM) copolymers commonly used in the prior art to provide an extruded strand shield in direct contact with the metallic conductor. This ESS layer had an average thickness of 0.008 inches (0.20 mm) and was applied to a 19 wire stranded conductor having a nominal diameter of 0.483 inches (1.23 cm). A 0.490 inch (1.25 cm) guide and an 0.505 inch (1.28 cm) guide were used to shape and apply the first polymeric layer. The extrusion zone and extrusion head were maintained at a temperature of 275° F. (135° C.).

The conductor, now covered with the polymeric ESS layer, was then passed to a dual head extrusion zone where a conventional insulating EP or EPDM copolymer was applied over the extruded strand shield coating to provide an insulation thickness of 0.6260 inches (1.59 cm). In addition, whithin the same extrusion head but subsequent to the application of the EPM or EPDM insulation, 0.046 inches (0.12 cm) of the semiconducting layer composition were applied as the first half-layer of the extrusion insulation shield. The dual head extruder consisted of an 0.525 inch (1.33 cm) guide, a 1.040 inch (2.64 cm) guide die and a 1.135 inch (2.88 cm) belt die. The EPDM insulation was supplied to the dual extrusion head through a 6 inch (15.2 cm) 20/1 extruder maintained at a temperature of 190° F.

(88° C.). Screw cooling utilizing 110° F. (43° C.) water was used in a standard deep flight rubber screw system. The extruded insulation shield polymer was applied through a 4.5 inch (11.4 cm) 15/1 extruder. The barrel and head of the extrusion zone were maintained at a temperature of 170° F. (77° C.). A standard deep flight rubber screw utilizing 125° F. (52° C.) cooling water was also utilized.

At this point in the process, the copper strand contained three layers of polymeric materials: an extruded strand shield, insulation and a half-layer of extruded insulation shield. The cable was then passed into a pressure tube which connected the dual head to the final extruder head. The pressure tube was maintained at 50 psig by the application of pressurized air or nitrogen. A process compatible process oil (a commercial material sold by Exxon Corp. under the name "Flexon 765") was applied to the surface of the coated cable just prior to the departure of the cable from the pressure tube and before entry of the cable into the final extruder head. The triple layer conductor now having an oil coating thereon was then passed to the final extrusion zone wherein six No. 17 corrugated copper drain wires were positioned on the surface of the cable just prior to the application of the second and final ethylene/acrylate/-ester copolymer half-layer of extruded insulation shield material. The half-layer was applied by the utilization of a 1.240 (3.15 cm) inch guide and a 1.270 inch (3.23 cm) die. The EIS material was supplied to the extrusion head through a 6 inch (15.2 cm) 20/1 extruder. Barrel and head temperatures were maintained at 170° F. (77° C.). 125° F. (52° C.) cooling water was used through a standard deep flight rubber screw.

The resultant conductor having embedded therein the six corrugated copper drain wires 4 positioned between the first and second layers of extruded insulation shield was then passed to a vulcanization or curing tube directly communicating with the final extrusion head. Within the vulcanization zone, each and every polymeric layer was simultaneously vulcanized at a pressure of 100 psig (6.8 atm gauge) in a dry nitrogen atmosphere. The vulcanization tube was 425 feet (130 m) in length and the cable was passed through the tube at a rate of 27 feet (8.2 m) per minute. The first 8.5 feet (2.6 m) of the vulcanization zone was an unheated splice box. The vulcanization zone was then divided into seven heated sections, each section 20 feet (6.1 m) long. Section 1 was maintained at 480° C. (896° F.); Section 2 was maintained at 430° C. (805° F.); Section 3 was maintained at 400° C. (752° F.); Section 4 was maintained at 385° C. (725° F.); Section 5 was maintained at 365° C. (689° F.); Section 6 was maintained at 365° C. (689° F.); and Section 7 was maintained at 345° C. (653° F.).

The vulcanized layered product, upon removal from the curing section, was then continuously quenched by passing through pressurized water maintained at a temperature of 70° F. (21° C.) and 100 psig (6.8 atm gauge). The water quench was approximately 175 feet (53 m) in length. The cable upon removal from the water quench was then passed through 200 feet (61 m) of water maintained at 70° F. (21° C.) and atmospheric pressure for additional cooling. The cable was then air dried and, where appropriate, surface printed. The cable was then taken up on reels using standard takeup equipment.

It is to be understood that the above described embodiments of the invention are merely illustrative of applications of the principles of this invention and that numerous other arrangements and modifications may be made within the spirit and scope of this invention.

What is claimed is:

1. A process for continuously manufacturing a multilayer electric cable comprising the steps of:

(a) providing an elongated conductive core;

(b) extruding at least one extrudable unvulcanized polymeric material around said elongated conductive core to form at least one layer of inner polymeric material coaxial with and contiguous to said conductive core;

(c) extruding an extrudable unvulcanized polymeric material capable of being strippably bonded to said inner polymeric material and comprising:

(i) a copolymer of ethylene, alkylacrylate, and monoalkyl ester of 1–4 butenedioic acid;

(ii) conductive carbon black;

(iii) a curing agent for said copolymer; and (iv) polyethylene or a polyethylene copolymer in an amount not to exceed 50 parts by weight of total polymer;

around said inner polymeric material to form a semiconducting outer layer of polymeric material coaxial with and contiguous to said inner polymeric material;

(d) simultaneously vulcanizing the combination of said inner and outer unvulcanized polymeric materials in a pressurized, high temperature, dry gas atmosphere; and (e) during said simultaneous vulcanizing step, strippably bonding said outer polymeric material and said inner polymeric material whereby the surfaces of the contiguous layers of said multilayer cable are minimally contaminated, and both the uniformity of adhesion between the layers and the continuity of the electric shield are enhanced.

2. A process for continuously manufacturing a multilayer electric cable comprising the steps of:

(a) providing an elongated conductive core as a center strand;

(b) extruding a first extrudable unvulcanized polymeric material around said elongated conductive core to form a strand shield layer of said first polymeric material coaxial with and contiguous to said conductive core;

(c) extruding a second extrudable unvulcanized polymeric material around said strand shield layer to form an insulation layer of said second polymeric material coaxial with and contiguous to said strand shield layer;

(d) extruding a third extrudable unvulcanized polymeric material capable of being strippably bonded to said insulation layer and comprising:

(i) a copolymer of ethylene, alkylacrylate and monoalkyl ester of 1–4 butenedioic acid;

(ii) conductive carbon black;

(iii) a curing agent for said copolymer; and (iv) polyethylene or a polyethylene copolymer in an amount not to exceed 50 parts by weight of total polymer; around said insulation layer to form a semiconductive outer insulation shield layer of said third polymeric material coaxial with and contiguous to said insulation layer;

(e) simultaneously vulcanizing the combination of said first, second and third unvulvanized polymeric materials in a pressurized, high temperature, dry gas atmosphere; and (f) during said simultaneous vulcanizing step, strippably bonding said insulation layer and said insulation shield layer whereby the surfaces of the contiguous layers of said multilayer cable are minimally contaminated and both the uniformity of adhesion between the layers and the continuity of the electric shield are enhanced.

3. A process for continuously manufacturing a multilayer electric cable as in claim 2 wherein the second extrudable unvulcanized polymeric material is the same as the first extrudable unvulcanized polymeric material.

4. A process for continuously manufacturing a multilayer electric cable as in claim 1 or 2 wherein the high temperature of the dry gas atmosphere is at least about 500° F.

5. A process for continuously manufacturing a multilayer electric cable as in claim 1 or 2 wherein the dry gas atmosphere is pressurized to at least 75 psig.

6. A process for continuously manufacturing a multilayer electric cable as in claim 1 or 2 further comprising the step of incorporating a plurality of axially extending drain wires disposed within the semiconducting unvulcanized outer layer after the semiconducting outer layer of polymeric material has been extruded.

7. A process for continuously manufacturing a multilayer electric cable as in claim 1 or 2 wherein the semiconducting outer layer of extrudable unvulcanized polymeric material comprises, in parts by weight per 100 parts by weight of total polymer:

| | |
|---|---|
| (a) conductive carbon black | 10–150 parts |
| (b) curing agent | 1–20 parts |
| (c) polyethylene or polyethylene copolymer | 17–50 parts. |

8. A process for continuously manufacturing a multilayer electric cable as in claim 7 wherein the semiconducting outer layer of extrudable unvulcanized polymeric material comprises in parts by weight:

| | |
|---|---|
| ethylene/acrylate/ester copolymer | 50–83 parts |
| polyethylene or polyethylene copolymer | 17–50 parts |
| conductive carbon black | 10–150 parts |
| curing agent | 1–20 parts. |

9. A process for continuously manufacturing a multilayer electric cable as in claim 8 wherein the semiconducting outer layer of extrudable unvulcanized polymeric material further comprises 31–99 parts by weight of additives selected from the group consisting of oxidation resistance improvers, lubricants, and flame retarders.

10. A process for continuously manufacturing a multilayer electric cable as in claim 8 wherein the semiconducting outer layer of extrudable unvulcanized polymeric material comprises, in parts by weight:

| | |
|---|---|
| ethylene/acrylate/ester copolymer | 75 parts |
| polyethylene or polyethylene copolymer | 25 parts |
| conductive carbon black | 25 parts |
| curing agent | 10 parts. |

11. A process for continuously manufacturing a multilayer electric cable as in claim 8 wherein the semiconducting outer layer of extrudable unvulcanized polymeric material comprises, in parts by weight:

| | |
|---|---|
| ethylene/acrylate/ester copolymer | 75 parts |
| polyethylene or polyethylene copolymer | 25 parts |
| conductive carbon black | 57 parts |
| curing agent | 10 parts. |

12. A process for continuously manufacturing a multilayer electric cable as in claim 10 wherein the semiconducting outer layer of extrudable unvulcanized polymeric material further comprises:

| | |
|---|---|
| antioxidant | 2.0 parts |
| lubricant | 4.5 parts |
| flame retarder | 49.5 parts. |

13. A process for continuously manufacturing a multilayer electric cable as in claim 11 wherein the semiconducting outer layer of extrudable unvulcanized polymeric material further comprises:

| | |
|---|---|
| antioxidant | 2.0 parts |
| lubricant | 4.5 parts |
| flame retarder | 49.5 parts. |

* * * * *

UNITED STATES PATENT AND TRADEMARK OFFICE

CERTIFICATE OF CORRECTION

PATENT NO. : 4,469,539

DATED : September 4, 1984

INVENTOR(S) : ROBERT M. WADE et al.

It is certified that error appears in the above—identified patent and that said Letters Patent is hereby corrected as shown below:

On the title page, item [75] inventors:

delete "George N. Benjammin", and insert -- George N. Benjamin--.

Signed and Sealed this

*Thirtieth* Day of *April 1985*

[SEAL]

*Attest:*

DONALD J. QUIGG

*Attesting Officer* *Acting Commissioner of Patents and Trademarks*